United States Patent [19]

Fischer et al.

[11] 3,933,498

[45] Jan. 20, 1976

[54] FOGGED, DIRECT POSITIVE SILVER HALIDE EMULSIONS CONTAINING A BLEACH INHIBITING COMPOUND AND A DMIN MAINTAINER COMPOUND

[75] Inventors: Leewellyn C. Fischer, Fairport; Heman Dowd Hunt, Webster, both of N.Y.

[73] Assignee: E. I. Du Pont de Nemours and company, Wilmington, Del.

[22] Filed: Sept. 28, 1973

[21] Appl. No.: 403,263

[52] U.S. Cl. ..... 96/64; 96/101; 96/109; 96/107; 96/108

[51] Int. Cl.[2] .. G03C 5/24; G03C 1/36; G03C 1/34; G03C 1/28

[58] Field of Search ..... 96/101, 109, 64, 107, 108

[56] References Cited

UNITED STATES PATENTS

| | | | |
|---|---|---|---|
| 3,050,395 | 8/1962 | Duffin | 96/101 |
| 3,062,651 | 11/1962 | Hillson | 96/101 |
| 3,526,507 | 9/1970 | Ishikawa et al. | 96/101 |
| 3,679,424 | 7/1972 | Barbier et al. | 96/109 |
| 3,782,957 | 1/1974 | Ohkubo et al. | 96/101 |

*Primary Examiner*—Won H. Louie, Jr.

[57] ABSTRACT

Direct positive silver halide materials based on the Herschel effect having substantially reduced sensitivity to room light exposure contain a heterocyclic compound to prevent white light bleaching along with a second heterocyclic compound to prevent latent image formation due to white light exposure.

4 Claims, No Drawings

FOGGED, DIRECT POSITIVE SILVER HALIDE EMULSIONS CONTAINING A BLEACH INHIBITING COMPOUND AND A DMIN MAINTAINER COMPOUND

BACKGROUND OF THE INVENTION

Field of the Invention

This invention relates to direct positive, silver halide material which is capable of producing a positive image by the Herschel reversal process. More particularly this invention relates to Herschel type direct positive materials with reduced room or white light sensitivity.

Description of the Prior Art

Direct positive silver halide materials based on the Herschel effect use a reversal phenomenon by which fogging nuclei in certain silver halide emulsions are bleached or destroyed by radiation, usually long wavelength, visible light or infrared radiation. It is also well known to enhance the sensitivity to bleaching of such direct positive materials by incorporating desensitizers into the fogged emulsion to increase speed and/or change spectral sensitivity. Desensitizers described in the prior art which enhance Herschel bleaching include heterocyclic compounds such as benzothiazole, quinoline, indolenine and benzotriazole having a nitro group attached to a benzene nucleus, and dyes such as Pinakryptol Yellow, Pinakryptol Green, and Phenosafranine as well as nitro substituted styryl dyes such as those disclosed in U.S. Pat. No. 2,669,515.

An advantage of the direct positive materials described above is that they can be handled for short periods of time in moderate room or white light. However, in the case of the more sensitive direct positive materials containing the above mentioned desensitizing dyes too much room light exposure results in low density images with high background fog. Such low density may result from spectrally sensitized bleaching due to shorter wavelength radiation, e.g., green, blue, and ultraviolet radiation of room light. High background fog presumably results from conventional room light induced latent image formation, i.e., the residual forward speed of the direct positive material. In U.S. Pat. No. 3,526,507 the use of tetraazaindine compounds is disclosed for the prevention of white light induced, low density images in autopositive reproduction materials but not for the reduction of white light induced background fog.

SUMMARY OF THE INVENTION

In a Herschel reversal type direct positive silver halide emulsion containing a desensitizing dye, the improvement comprises a combination of a bleach inhibiting compound which retards bleaching of fogging nuclei by short wavelength radiation (i.e., below about 530 nM) and a Dmin maintainer compound which inhibits residual latent image formation. This improvement employs two different compounds to protect the direct positive emulsion from the detrimental components of room light. It has been found that such a combination of compounds provides the best protection for direct positive material and permits handling of such material in room light without undue deleterious effect on image contrast.

The direct positive emulsion is a colloid silver halide emulsion, preferably gelatino silver halide, having fogging nuclei bleachable by long wavelength visible radiation. For the purpose of this invention long wavelength visible radiation includes the spectrum between about 530nM and about 800nM. A bleach inhibiting compound is a compound which retards the Herschel bleaching of fogging nuclei by short wavelength radiation, i.e., radiation having a wavelength less than about 530nM. A Dmin maintainer is a compound which inhibits residual latent image formation by room light. The Dmin maintainer may maintain dye desensitization and may be a desensitizer for conventional latent image formation by short wavelength radiation.

DESCRIPTION OF THE PREFERRED EMBODIMENTS

The bleach inhibiting compound and the Dmin maintainer each can be used in the concentration range between about 0.01 to 10g per mole of silver halide. They should be present in amounts large enough to provide a significant improvement in resisting the deleterious effects of room light. The bleach inhibiting compound is preferably present in an amount sufficient to provide a normalized yellow/yellow-plus-blue ratio, as hereinafter defined, of at least 1.1 and, most preferably, greater than about 1.5. The Dmin maintainer is preferably present in an amount sufficient to provide a normalized forward speed, also as defined hereinafter, of no more than 0.87 and, most preferably, no more than about 0.75. If desired, a plurality of bleach inhibiting and Dmin maintaining compounds can be used.

In a preferred embodiment of this invention the Herschel type direct positive material comprises a support with a photographic layer of gelatino silver chloride, silver iodochloride, silver chlorobromide, silver bromide or silver iodobromide emulsion having fogging nuclei bleachable by visible radiation with wavelengths above about 530nM. The emulsion is characterized in that it contains:

1. a desensitizing dye such as Phenosafranine, Pinakryptol Yellow, Pinakryptol Green, styryl dyes such as those disclosed in U.S. Pat. No. 2,669,515, cyanine dyes such as those disclosed in U.S. Pat. No. 3,539,394, dyes containing an imidazol [4,5-b] quinoxaline nucleus such as those disclosed in U.S. Pat. No. 3,632,808, etc., 2. a bleach inhibiting compound, e.g., a heterocyclic compound taken from the group consisting of benzotriazoles such as 5-nitrobenzotriazole, and 5-chlorobenzotriazole; benzothiazoles such as 6-amino-2-(methylthio)-benzothiazole, 6-methyl-2-(p-aminophenyl)-benzothiazole, 2-amino-6-methylbenzothiazole, 2-amino-6-methoxybenzothiazole, 2-amino-5,6-dimethylbenzothiazole, 6-amino-2-methyl-7-nitrobenzothiazole, and 6-amino-4-mercaptobenzothiazole; thiazoles such as 2-amino-5-nitrothiazole, 2-aminothiazole, 2-amino-4-methylthiazole, 2-amino-4,5-dimethylthiazole, 2-amino-5-(p-nitrophenyl-sulfonyl)-thiazole, 2-acetaminothiazole, 2-amino-4-phenyl-5-ethylthiazole, 2-amino-4-(chloromethyl)thiazole-Hcl, 2-amino-5-nitrothiazole, 2,4-dihydroxythiazole-5-acetic acid, and 2-amino-5-bromothiazole; 2-amino-5-ethyl-4-phenyloxazole; 4-amino-6-chloro-5-nitropyridine; 5-aminoindiazole; 4-benzoyliminio-3-t-butyl-1,3-thiazilidine-2-thione; and 4-benzoylimino-3-phenyl-1,3-thiazilidine-2-thione, and 3. a Dmin maintainer, e.g., a heterocyclic compound taken from the group consisting of pyridines such as 2-amino-5-nitropyridine, 2-amino-4-methyl-2-nitropyridine, 2-amino-4-methyl-3-nitropyridine, and 2-amino-3-nitropyridine; pyromellitimide; indazoles such as 5-nitroindazole, 6-nitroindazole, 3-chloro-5-nitroindazole, and 3-chloro-6-nitroindazole; triazoles such as 5-nitrobenzotriazole. 5-chlorobenzotriazole, benzotriazole, and 3-amino-1H-1,2,3-triazole; thiazoles such as 2-amino-5-nitrothiazole, 2-methyl-6-nitrobenzothiazole, 2-mercapto-6-nitrobenzothiazole, 2-acetamido-5-(p-nitrophenylmercapto)-thiazole, and 6-amino-2-methyl-7-nitrobenzothiazole; 2-amino-5-chlorobenzoxazole; 2-nitrothiophene; imidazoles such as 5-nitrobenzimidazole and 5-nitro-2-benzimidazole-thiol; 8-nitro-quinoline; and m-nitrobenzamidine. Compounds which are not heterocyclic but also function as Dmin maintainers are 5-nitroanthraquinone sulfonic acid and p-nitrobenzenediazonium fluoborate. Several hetrocyclic compounds can function both as a bleach inhibiting compound and a Dmin maintainer. However, for the purpose of this invention at least two different compounds are required, one for each function.

In a particularly preferred embodiment of this invention a direct positive material, which is virtually insensitive to radiation below 530nM, comprises a formaldehyde fogged gelatino silver chloride emulsion to which is added N-methyl-4-(m-nitrostyryl) cinnolinium p-toluene sulfonate, 5-nitrobenzotriazole, and 2-amino-5-nitropyridine.

The silver halide emulsions useful in the invention may be prepared and fogged by any of the conventional methods for preparing direct positive materials subject to Herschel bleaching. Such emulsions include regular monodisperse emulsions as well as emulsions having wide grain-size distribution and irregular grain habit. Such emulsions also include mixed emulsions prepared from separate emulsions with different grain size distribution or habit or from separate emulsions which have been fogged to different levels.

Generally the components of the desensitizing combination are added after the emulsion is fogged. The direct positive silver halide emulsion of this invention may contain other conventional adjuvants such as coating aids, gelatin hardeners, or antihardeners, developing agents, etc. Similarly, the direct positive emulsion may be coated on any of the well known supports. The coated direct positive material may be overcoated with a layer to provide antiabrasion protection, antistatic protection, and/or a matte surface. The direct positive element may also have conventional auxiliary layers such as subcoatings, antihalation layers or back coatings.

In the following examples, the invention is illustrated, and the normalized yellow/yellow-plus-blue ratio and normalized forward speed are defined as described therein.

EXAMPLE 1

To 1.2 Kg of a pure silver chloride emulsion, containing the equivalent to 0.3 moles silver, was added 10 mg 1-phenyl-5-mercaptotetrazole. After adjusting the pH to about 8, the emulsion was heated to 55°C then 1.5 g formaldehyde was added and the emulsion held at 55°C for about 20 min. The emulsion was cooled and pH adjusted to about 5.5. 80 mg of N-methyl-4-(m-nitrostyryl)cinnolinium p-toluene sulfonate was added to the emulsion which was then split into two equal portions. One portion was used with no further adjuvants as a control. 30 mg 5-nitrobenzotriazole and 0.4 g 2-amino-5-nitro-pyridine were added to the second portion. Each portion was coated on a separate subbed polyethylene terephthalate support and dried. A sample of each portion was imagewise exposed through a combination of a $\sqrt[3]{2}$ photographic step tablet and an amber sheet which substantially transmits radiation above 530nM on the average (e.g., DP480 amber sheeting sold by the Du Pont Co., transmitting 0 percent of incident light below 480nM, 1 percent at 480nM, and 90 percent at and above 600nM) to 100 lux of light from a xenon arc. These samples were then exposed to daylight-type fluoroescent lights (Westinghouse F40D, 40 watt) at 50 foot candles for 5 minutes while half of each sample was masked to prevent room light exposure. Both samples were processed using conventional hydroquinone developer, and fixer. The following table shows the effect of room light exposure on Dmin and Dmax for the control sample and the sample containing the two heterocyclic adjuvants. As can be seen from results in the table, Dmin is maintained at 0.04 upon exposure to roomlight by incorporation of the two heterocyclic adjuvants. Also, room light bleaching is substantially inhibited by the adjuvants.

TABLE I

| Sample | Room Light Exposure | Dmin | Dmax |
|---|---|---|---|
| Control | No | 0.04 | 3.00 |
| | Yes | 0.30 | ~0.30 |
| With Adjuvants | No | 0.04 | 3.05 |
| | Yes | 0.04 | 2.50 |

A quantitative measure of room light bleaching inhibition due to the adjuvants was obtained using the following procedure. A sample of the portion containing the adjuvants was imagewise exposed to 100 lux of light from a xenon arc through $\sqrt[3]{2}$ step tablet and DP480 amber sheeting. A second sample was similarly exposed except that instead of the DP480 amber sheeting, a Du Pont Varigam No. 4 filter was used. The Varigam No. 4 filter transmits 0 percent of incident light at 300nM, 47.5 percent at 360nM, 17.5 percent at 450nM, and 90 percent or more from 600 to 800nM. Both samples were processed and photographic positive speed determined by conventional methods. The ratio of yellow speed to yellow-plus-blue speed was calculated from the measured speeds using the amber sheeting and the Varigam filter respectively and was normalized by dividing by a similar ratio determined for control samples. If the adjuvants provide no protection to blue or white light bleaching the resulting normalized yellow/yellow-plus-blue ratio is 1. A higher value of 4.1 was obtained for the normalized ratio indicating that the adjuvants are inhibiting blue or white light bleaching.

A quantitative measure of Dmin maintenance due to the adjuvants was obtained using the following procedure. A sample of the portion containing adjuvants and a control sample were uniformly exposed through the DP480 amber sheeting to 100 lux of light from a xenon arc. Each sample was then exposed through a combination of a $\sqrt{2}$ step tablet and opal glass to 100 lux of light. Each sample was processed and forward-speed determined using conventional techniques. If the adjuvants do not reduce the rise in Dmin due to white light exposure the ratio of forward speed of adjuvant-containing sample to the forward speed of the control will be 1. A lower value of less than 0.1 was obtained for the normalized forward speed indicating that the adjuvants maintain Dmin at a low value during white light exposure.

EXAMPLE 2

Example 1 was repeated except that the emulsion was chemically fogged using the fogging agent and procedure described in Example VII of Bigelow, U.S. Pat. No. 3,637,392 in place of formaldehyde. The results obtained were substantially the same as for Example 1.

EXAMPLE 3

To 3.6 Kg of a pure, cubic, monodisperse, silver chloride emulsion, containing the equivalent to 0.9 moles silver, was added 30 mg 1-phenyl-5-mercaptotetrazole. The emulsion was fogged using the procedure of Example 1 and was then split into six equal parts. One of the following desensitizing dyes was added to each part in the amount indicated:

- 40 mg of N-methyl-4-(m-nitrostyryl)-cinnolinium p-toluene sulfonate
- 200 mg of N-methyl-2-(m-nitrostyryl)-6-ethoxyquinolinium p-toluene sulfonate.
- 200 mg of N-Methyl-2-(p-nitrostyryl)-6-ethoxyquinolinium p-toluine sulfonate
- 100 mg of 4,4'-(diethylamino) triphenylmethylhydrosulfate
- 100 mg of phenosafranine
- 125 mg of 2-[(2-methyl-5-oxo-3-phenyl-3-isoxazolin-4-yl)vinyl]-6-nitro-3-methyl-benzothiazolium p-toluene sulfonate.

Each part was further split into two equal portions. One portion of each part was used with no further adjuvants as a control. To the remaining portion of each part was added 15 mg of 5-nitrobenzotriazole and 0.2g 2-amino-5-nitropyridine. All 12 portions (6 portions with adjuvants and 6 corresponding control portions) were coated, dried, and samples tested as in Example 1. Each sample containing the adjuvants showed substantially the same resistance to white light bleaching and to the concurrent build-up of background density (D-min).

EXAMPLE 4

A Herschel bleaching, direct positive, silver chloride emulsion was prepared as described in Example 2 except that after the desensitizing dye was added the emulsion was split into 3 equal portions. One portion was used with no further adjuvants as a control. To the second portion 0.027g of 5-nitrobenzotriazole was added and to the third portion 0.133g of 2-amino-5-nitropyridine was added. Each portion was coated on a separate subbed polyethylene terephthalate support and dried.

A sample of the coating of the second emulsion portion containing 5-nitrobenzotriazole as well as a sample of the control coating were quantitatively measured for their room light bleaching inhibition using the procedure described in Example 1. The normalized yellow/yellow-plus-blue ratio was found to be 9.2 indicating that 5-nitrobenzotriazole is very efficient in inhibiting blue or white light bleaching.

A sample of the coating of the third emulsion portion containing 2-amino-5-nitropyridine as well as a sample of the control coating were quantitatively measured for their Dmin maintenance using the procedure described in Example 1. The normalized forward speed was found to be 0.26 indicating that 2-amino-5-nitropyridine is very effective in maintaining Dmin at a low value during white light exposure.

EXAMPLE 5

The effectiveness of a number of bleach inhibiting heterocyclic compounds in reducing room light sensitivity was quantitatively measured as described in Example 4. The following table presents the bleach inhibiting heterocyclic compound, the grams of compound used per mole of silver chloride, and the resulting normalized (yellow/yellow-plue-blue) ratio.

TABLE II

BLEACH INHIBITING HETEROCYCLICS

| Compound | g. Compound Mole AgCl | Normalized Ratio |
|---|---|---|
| 2-amino-4-methylthiazole | 1.33 | 6.2 |
| 4-amino-6-chloro-5-nitro-pyridine | 1.33 | 5.2 |
| 6-amino-2-methyl-7-nitrobenzo-thiazole | 1.33 | 3.9 |
| 2-amino-4-(chloromethyl)thiazole-HCl | 1.33 | 3.4 |
| 6-amino-2-(methylthio)benzo-thiazole | 1.33 | 2.6 |
| 6-amino-4-mercaptobenzo-thiazole | 1.33 | 2.5 |
| 2-acetaminothiazole | 1.33 | 2.4 |
| 6-methyl-2-(p-aminophenyl)-benzothiazole | 1.33 | 2.3 |
| 2-amino-5-nitrothiazole | 1.33* | 2.3 |
| 5-aminoindozole | 1.33 | 2.3 |
| 2-amino-5,6-dimethylbenzo-thiazole | 1.33 | 2.1 |
| 2-amino-5-(p-nitrophenyl-sulfonyl)thiazole | 1.33 | 2.1 |
| 2-amino-5-ethyl-4-phenyl-oxazole | 1.33 | 2.0 |
| 2-amino-4-phenyl-5-ethyl-thiazole | 1.33 | 1.9 |
| 2-aminothiazole | 0.67 | 1.8 |
| 5-chlorobenzotriazole | 0.67 | 1.7 |
| 2-amino-4,5-dimethylthiazole | 1.33 | 1.6 |
| 4-benzoylimino-3-t-butyl-1,3-thiazetidine-2-thione | 1.33 | 1.6 |
| 2-amino-5-nitrothiazole | 0.67* | 1.6 |
| 2-amino-6-methylbenzothiazole | 1.33 | 1.5 |
| 2-amino-6-methoxybenzothiazole | 1.33 | 1.3 |
| 2-amino-5-bromothiazole | 1.33 | 1.4 |
| 4-benzoylimino-3-phenyl-1,3-thiazetidine-2-thione | 1.33 | 1.2 |
| 2,4-dihydroxylthiazole-5-acetic acid | 1.33 | 1.1 |
| Control | 0 | 1 |

A control value of 1 has been included in the table to indicate the limit of effectiveness where there is no improvement in room light bleaching protection. The higher the normalized speed ratio the greater is the improvement in room light bleaching protection. Two concentrations of 2-amino-5-nitrothiazole (designated by an asterisk) give results in which when the concentration is doubled the improvement in the normalized ratio is essentially doubled.

EXAMPLE 6

The effectiveness of a number of heterocyclic Dmin maintainers in reducing forward speed due to room light exposure was quantitatively measured as described in Example 4. The following table presents the heterocyclic Dmin maintainer, the grams of the compound used per mole of silver chloride, and the normalized forward speed.

TABLE III

| DMIN MAINTAINERS | | |
|---|---|---|
| Compound | g. Compound Mole AgCl | Normalized Forward Speed |
| pyromellitimide | 0.67 | 0.15 |
| 2-amino-4-methyl-3-nitro-pyridine | 1.33 | 0.30 |
| benzotriazole | 2.13 | 0.34 |
| 6-nitroindazole | 0.67 | 0.35 |
| m-nitrobenzamidine | 0.67 | 0.36 |
| 5-nitrobenzimidazole | 0.67 | 0.37 |
| 5-nitroanthraquinone sulfonic acid | 1.33 | 0.39 |
| 2-amino-3-nitropyridine | 1.33 | 0.41 |
| 2-amino-5-nitrothiazole | 0.67 | 0.44 |
| 5-nitro-2-benzimidazolethiol | 1.33 | 0.45 |
| 2-mercapto-6-nitrobenzo-thiazole | 0.67 | 0.48 |
| 3-chloro-6-nitroindazole | 0.67 | 0.50 |
| 5-nitrobenzotriazole | 0.67 | 0.50 |
| 5-chlorobenzotriazole | 0.67 | 0.50 |
| 5-nitroindazole | 0.67 | 0.52 |
| 6-amino-2-methyl-7-nitrobenzo-thiazole | 1.33 | 0.53 |
| 2-amino-5-chlorobenzoxazole | 1.33 | 0.55 |
| 8-nitroquinoline | 0.67 | 0.56 |
| 2-methyl-6-nitrobenzothiazole | 1.00 | 0.57 |
| 3-amino-1H-1,2,3 triazole | 0.67 | 0.64 |
| p-nitrobenzenediazonium fluo-borate | 0.67 | 0.67 |
| 2-nitrothiophene | 1.33 | 0.68 |
| 3-chloro-5-nitroindazole | 0.67 | 0.70 |
| 2-amino-4-methyl-2-nitropyridine | 0.27 | 0.75 |
| 2-acetamido-5-(p-nitrophenyl mercapto)thiazole | 1.33 | 0.87 |
| Control | 0 | 1 |

A control value of 1 has been included in the table to indicate the limit of effectiveness where there is no reduction in room light induced forward speed. The lower the normalized forward speed the greater is the improvement in maintaining Dmin during room light exposure.

EXAMPLE 7

A fogged emulsion was prepared as in Example 1 which contained 0.6 mole silver chloride but no 5-nitrobenzotriazole or 2-amino-5-nitropyridine. The emulsion was split into four equal portions. One portion was used with no further adjuvants as a control. To each of the three remaining portions the following heterocyclic combinations were added:

| | | |
|---|---|---|
| A: | 2-amino-4-methylthiazole | 0.2 g |
| | 2-amino-5-nitropyridine | 0.4 g |
| B: | 2-amino-4-methylthiazole | 0.2 g |
| | 2-amino-5-nitrothiazole | 0.3 g |
| C: | 5-nitrobenzotriazole | 0.3 g |
| | 2-amino-5-nitrothiazole | 0.3 g |

The four portions were coated as in Example 1 and normalized (yellow/yellow-plus-blue) speed ratios and normalized forward speed were determined. Results presented in the following table indicate that the heterocyclic combinations reduced white light sensitivity of the Herschel direct positive emulsion.

TABLE IV

| Heterocyclic Combination | Normalized Ratio | Normalized Forward Speed |
|---|---|---|
| A | 2.0 | 0.75 |
| B | 1.8 | 0.87 |
| C | 2.8 | 0.25 |

EXAMPLE 8

Example 2 was repeated except that 0.2 g of 5-nitrobenzotriazole per mole silver chloride was used as the bleach inhibiting heterocyclic compound and 1.78 g of 2-amino-5-nitropyridine per mole silver chloride was used as the heterocyclic Dmin maintainer. The resulting normalized (yellow/yellow-plus-blue) speed ratio was 3.1 indicating that the adjuvants are inhibiting blue or white light bleaching. The resulting normalized forward speed was 0.1 indicating that the adjuvants maintain Dmin at a low value during white light exposure.

What is claimed is:

1. In a Herschel reversal type direct positive silver halide emulsion having prefogged silver halide grains containing a desensitizing dye, the improvement comprising a combination of a bleach inhibiting compound which retards bleaching of fogging nuclei by short wavelength radiation and a different Dmin maintainer compound which inhibits residual latent image formation said bleach inhibiting compound being selected from the group consisting of 5-nitrobenzotriazole, 5-chlorobenzotriazole, 6-amino-2-(methylthio)-benzothiazole, 6-methyl-2-(p-amino-phenyl)-benzothiazole, 2-amino-6-methylbenzothiazole, 2-amino-6-methoxybenzothiazole, 2-amino-5,6-dimethylbenzothiazole, 6-amino-2-methyl-7-nitrobenzothiazole, 6-amino-4-mercaptobenzothiazole, 2-amino-5-nitrothiazole, 2-aminothiazole, 2-amino-4-methylthiazole, 2-amino-4,5-dimethylthiazole, 2-amino-5-(p-nitrophenyl-sulfonyl)-thiazole, 2-acetaminothiazole, 2-amino-4-phenyl-5-ethylthiazole, 2-amino-4-(chloromethyl) thiazole-HCl, 2-amino-5-nitrothiazole, 2,4-dihydroxythiazole-5-acetic acid, 2-amino-5-bromothiazole, 2-amino-5-ethyl-4-phenyl-oxazole, 4-amino-6-chloro-5-nitropyridine, 5-aminoindiazole, 4-benzoylimino-3-t-butyl-1,3-thiazilidine-2-thione, 4-benzoylimino-3-phenyl-1,3-thiazilidine-2-thione, and said Dmin maintainer compound being selected from the group consisting of 2-amino-5-nitropyridine, 2-amino-4-methyl-2-nitropyridine, 2-amino-4-methyl-3-nitropyridine, 2-amino-3-nitropyridine, pyromellitimide, 5-nitroindazole, 6-nitroindazole, 3-chloro-5-nitroindazole, 3-chloro-6-nitroindazole, 5-nitrobenzotriazole, 6-chlorobenzotriazole, benzotriazole, 3-amino-1H-1,2,3,-triazole, 2-amino-5 -nitrothiazole, 2-methyl-6-nitrobenzothiazole, 2-mercapto-6-nitrobenzothiazole, 2-acetamido-5-(p-nitrophenylmercapto)-thiazole, 6-amino-2-methyl-7-nitrobenzothiazole, 2-amino-5-chlorobenzoxazole, 2-nitrothiophene, 5-nitrobenzimidazole, 5-nitro-2-benzimidazole-thiol, 8-nitroquinoline, m-nitrobenzamidine, 5-nitroanthraquinone sulfonic acid and p-nitrobenzenediazonium fluoborate.

2. A direct positive silver halide emulsion according to claim 1 wherein said bleach inhibiting compound is 5-nitrobenzotriazole and said Dmin maintainer compound is 2-amino-5-nitropyridine.

3. Photographic material comprising a support bearing a layer of the direct positive silver halide emulsion of claim 1.

4. A method of producing a direct positive print with improved contrast comprising imagewise exposing the photographic material of claim 3 to actinic light and developing the exposed material to produce a direct positive print.

* * * * *